US008323061B2

(12) United States Patent
Hori

(10) Patent No.: US 8,323,061 B2
(45) Date of Patent: Dec. 4, 2012

(54) MINIATURE RECEPTACLE TERMINALS

(75) Inventor: Takayuki Hori, Kanagawa (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 13/145,483

(22) PCT Filed: Jan. 20, 2009

(86) PCT No.: PCT/US2009/031450

§ 371 (c)(1),
(2), (4) Date: Sep. 21, 2011

(87) PCT Pub. No.: WO2010/085240

PCT Pub. Date: Jul. 29, 2010

(65) Prior Publication Data

US 2012/0003881 A1 Jan. 5, 2012

(51) Int. Cl.
*H01R 11/22* (2006.01)

(52) U.S. Cl. ..... 439/852

(58) Field of Classification Search ..... 439/852, 439/851, 843, 845

See application file for complete search history.

(56) References Cited

U.S. PATENT DOCUMENTS

| | | | | |
|---|---|---|---|---|
| 5,658,174 | A | 8/1997 | Benes et al. | |
| 5,980,336 | A | 11/1999 | Hall et al. | |
| 6,293,833 | B1 * | 9/2001 | Kamath | 439/851 |
| 2006/0068650 | A1 | 3/2006 | Shimizu | |
| 2011/0086557 | A1 * | 4/2011 | Kubota | 439/842 |

FOREIGN PATENT DOCUMENTS

EP 1 643 598 A1 4/2006

OTHER PUBLICATIONS

International Search Report for PCT/US2009/031450.

* cited by examiner

*Primary Examiner* — Phuong Dinh
(74) *Attorney, Agent, or Firm* — Larry I. Golden

(57) ABSTRACT

This approach generally pertains to a miniature terminal receptacle (10) with a connection section (12) and a mating section (14). The mating section has a pseudo- two-beam component that includes a contact spring (20) having a stationary beam, a resilient contact beam (24) and a beam overlapping section (26). The resilient contact beam has a contact bump (40) and a stiffening section (30) with a pivotal point (38). The shape of the contact spring increases the contact engagement or holding force on a male pin during mating. Overstress protection of the contact spring is provided and the terminal is economical to produce.

22 Claims, 2 Drawing Sheets

10
14
16
18
48
50
52
54
L1
W1

MINIATURE RECEPTACLE TERMINALS

BACKGROUND OF THE INVENTION

This present invention generally pertains to receptacle terminals and more particularly to miniature receptacle terminals with enhanced pin contact force.

DESCRIPTION OF BACKGROUND ART

The automotive market is shifting to downsized, small-footprint types of receptacle terminals. It is generally known that contact engagement or holding force of receptacle terminals become weaker as the terminals become smaller since the contact springs become proportionally smaller. Attempts have been made to increase the contact engagement or holding force of smaller contact springs by stacking smaller contact springs together, for example, employing two contact springs together to double the combined spring thickness in an attempt to double contact force. Variation of tolerance due to multiple springs, however, often results in unacceptably large variations of contact engagement or holding force and manufacturing control is complicated. Attempts have also been made to reinforce the thickness of the contact springs employing dimples or beads but this approach has also meet with limited success.

Prior art approaches that have not recognized the positives that could be gained by seeking to achieve the objectives or teach solutions than those of the present approach include U.S. Pat. No. 5,873,754 that pertains to a single piece electrical receptacle terminal with a compact rigid transition section that interconnects a connection section to a contact section. A sidewall of the transition section is provided with flaps that are crimped over an opposite side wall, and extensions of contact arms are sandwiched between the transition side sections to provide rigidity. U.S. Pat. No. 5,980,336 relates to an electrical terminal with automotive applications having a body portion with an entry, an exit and an interior chamber. The chamber has a movable contact-spring member for pressing into a male blade. The body also has a spring preloading tab and a lip that provides overstress protection for the contact-spring. U.S. Pat. No. 6,095,874 pertains to a single piece receptacle terminal that comprises a contact section in the form of a box having a front wall and short mating sidewalls extending from the front of the box. The sidewalls assist in protecting the contact area.

Other prior art includes the following. U.S. Pat. No. 6,244,910 relates to a box receptacle terminal formed from a stamped blank with a cantilevered contact-spring. The contact-spring is outwardly deflected relative to the receptacle base when mated with a male contact such as a blade or pin terminal. U.S. Pat. No. 7,223,134 pertains to single-piece contact with a rear zone that connects to an electrical conductor. On the front of the contact is a protective cage with a contact terminal having at least two elastic contact blades that mate with a male terminal. U.S. Pat. No. 7,241,190 relates to box-shaped tubular female terminals comprising a section for connecting to a conducting wire and a section for mating with a male terminal. A contact-spring is disposed within the contact section and the contact-spring is protected from damage by prohibiting access to the contact-spring's leading edge. The insertion portion of the mating section has a smaller diameter than the remaining portion of the mating section. The leading edge of the contact-spring is positioned above the smaller diameter walls of the insertion portion for protection. U.S. Pat. No. 7,351,122 pertains to a receptacle terminal comprising a contact beam with spring protection members.

The contact section is formed with a metal plate having opposing first and second contacts that extend at right angles to each other and thus form an L-shaped cross-section. Both contact-springs apply pressure to a mating terminal to ensure contact pressure between the receptacle terminal and the mating terminal.

With the present approach, it has been determined that various characteristics of prior art, such as these patents, have shortcomings and undesirable attributes, results or effects. The present approach recognizes and addresses matters such as these to provide enhancements not heretofore available. Overall, the present approach provides more fully enhanced miniature contact springs that provide increased contact force.

More specifically, goals that have been arrived at in accordance with the present approach, while maintaining good manufacturing control and minimizing variation of tolerance, include increasing the contact engagement or holding force of a contact spring. Other goals include protecting the contact spring form damage in its operating environment, protecting the contact spring and the contact pin from damage during insertion of a male contact pin, providing overstress protection for the contact spring, improving material efficiency and polarizing the receptacle terminal for mounting.

SUMMARY OF THE INVENTION

An embodiment of the present approach generally pertains to a mating section of a miniature receptacle terminal. The mating section has a pseudo-two-beam spring contact component that includes a contact spring with a stationary beam, a resilient contact beam and a beam overlapping section. The resilient contact beam has a contact bump and a stiffening section that includes a straight beam and a bent beam with a pivotal point. The shape of the contact spring significantly increases the contact force on a male pin during mating. The pseudo-two-beam component permits good manufacturing control and minimizes contact force variation from miniature receptacle terminal to miniature receptacle terminal.

In another embodiment of the miniature receptacle terminal the pseudo-two-beam spring contact is secured from the rear of the mating section improving material efficiency. High terminal performance is obtained with low manufacturing cost.

In an additional embodiment of the miniature receptacle terminal the pseudo-two-beam spring contact is secured within a box shaped mating section protecting the spring contact from damage that can be caused by the operating environment.

In another embodiment of the miniature receptacle terminal the stiffening beam has a depression protecting the resilient contact beam from overstress.

In a further embodiment of the miniature receptacle terminal the mating section has a polarization and locking projection that assists in mounting the miniature terminal.

Another embodiment of the miniature receptacle terminal has a guide end ramp to assist in mating and to protect the mating pin from damage during insertion.

In an additional embodiment of the miniature receptacle terminal the resilient contact beam has an inclined panel to protect the resilient contact beam from damage during mating.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific details disclosed herein are not to be interpreted as limiting, but merely as a basis for the claims and as a representative basis for teaching one skilled in the art to variously employ the present invention in virtually any appropriate manner, including employing various features disclosed herein in combinations that might not be explicitly disclosed herein.

Figures 1, 2, 3:
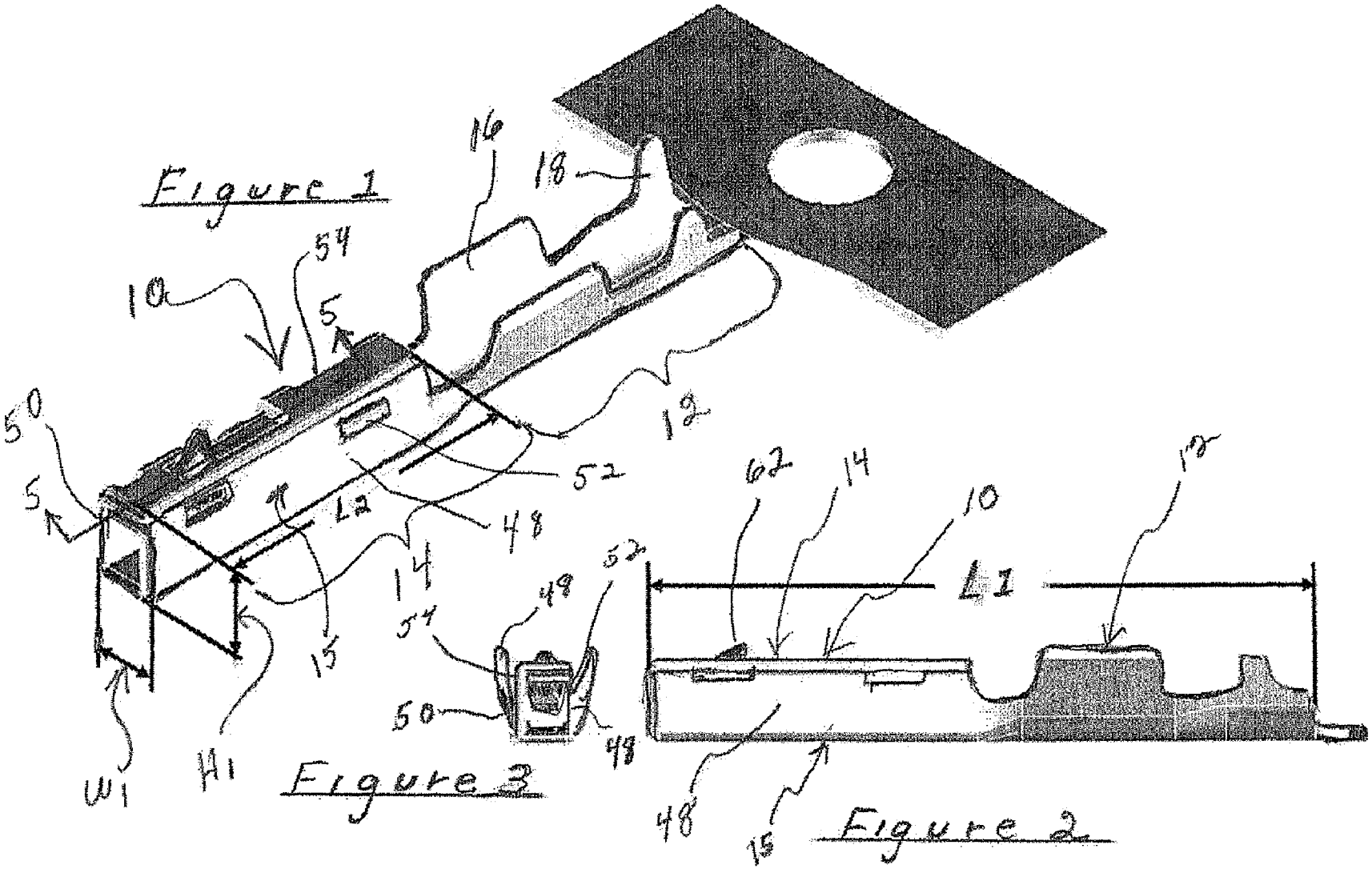
FIG. 1 is a perspective view of a miniature terminal receptacle according to the present approach.
FIG. 2 is a side elevation view of the miniature terminal receptacle shown in FIG. 1.
FIG. 3 is a front elevation view of the miniature terminal receptacle shown in FIG. 1.

In an embodiment of this approach as shown in FIGS. 1-3, miniature receptacle terminals, generally shown as 10, have a connection section 12 for connection to a conductor (not shown) such as a wire conductor and an opposing box-shaped mating section 14 for mating with a complementary male terminal (not shown). Connection section 12 has sidewalls 16 for securely engaging, such as by crimping to a conductor such as the conductor of an insulated wire. For example, the connection section can have individual arms 18 which can wrap around the insulation of the insulated wire.

Terminal 10 has a length (L1) suitable for a miniature receptacle terminal that can be, for example, between about 9 mm and about 12 mm, suitably between about 9.5 mm and about 11.5 mm, typically between about 10 mm and about 11 mm. Mating section 14 has a housing, generally shown as 15. Housing 15 has length (L2) which can be, for instance, between about 4 mm and about 6 mm, suitably between about 4.8 mm and about 5.2 mm. Housing 15 also has width (W1) that can be, for example, between about 0.7 mm and about 1.3 mm, typically between about 0.8 mm and about 1.1 mm. Housing 15, in addition, has height (H1) that can be, for instance, between about 1.0 mm and about 1.6 mm, usually between about 1.2 mm and about 1.4 mm.

Figures 4, 5, 6, 7:
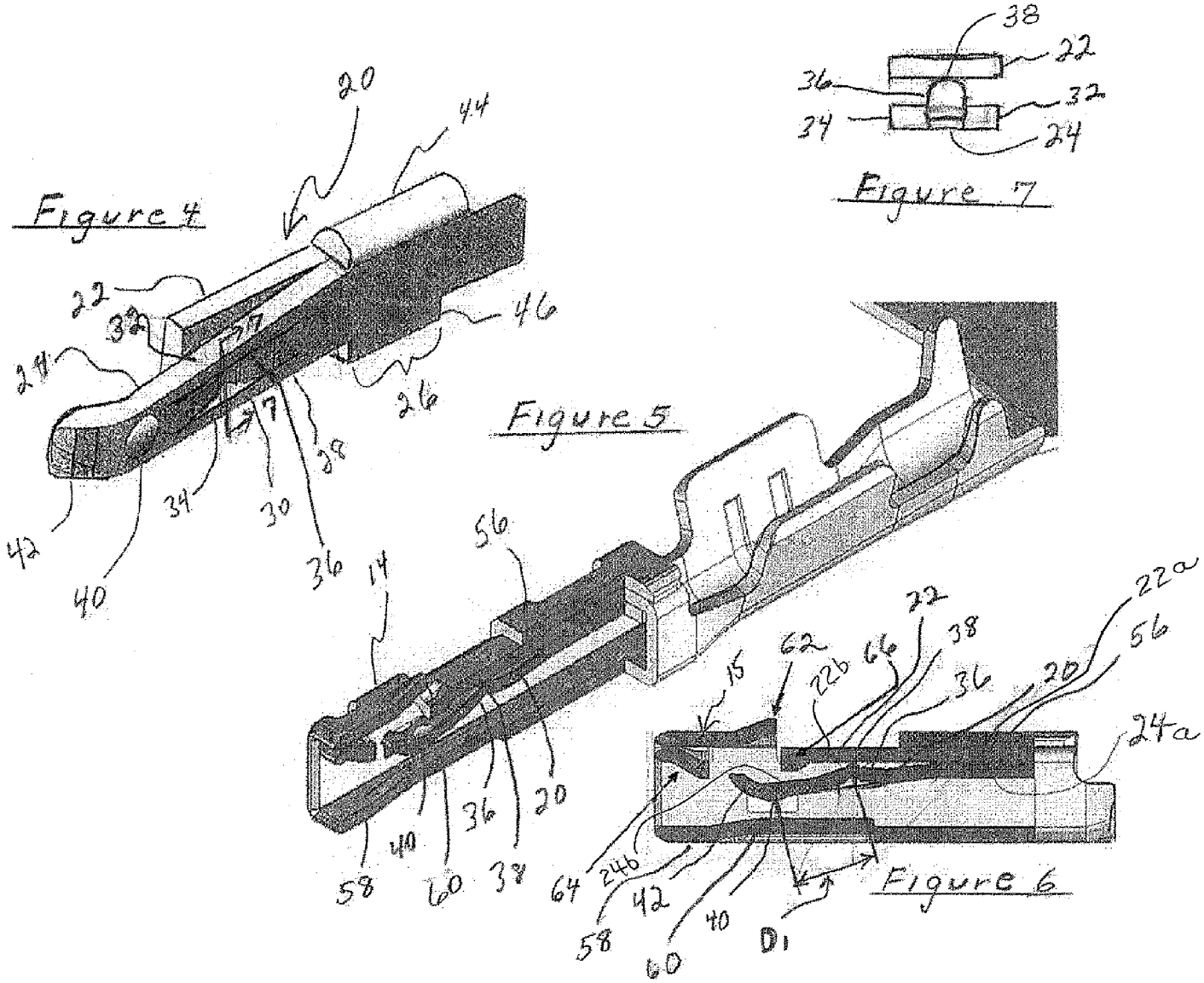
FIG. 4 is a perspective view of a contact spring according to the present approach.
FIG. 5 is a perspective view of the miniature terminal receptacle shown in FIG. 1, partially cut away as a cross-section taken along line 5-5 of FIG. 1.
FIG. 6 is a side elevation view of the cut-away portion of the mating section of the miniature terminal receptacle shown in FIG. 5.
FIG. 7 is a cross-sectional view of the contact spring shown in FIG. 4 taken along line 7-7 of FIG. 4.

A spring contact, generally designated 20, is shown in FIGS. 4, 5, 6 and 7. Spring contact 20 is positioned within housing 15 and includes a stationary beam portion 22 and a resilient contact beam portion 24, each having a proximal length 22*a*, 24*a* and a distal length 22*b*, 24*b*, respectively. The proximal lengths 22*a*, 24*a* generally coincide with an overlapping portion 26. Spring contact 20 can be considered a pseudo-two-beam component. Contact beam portion 24 is positioned in a direction considered downwardly (as shown in FIG. 4) from stationary beam portion 22. Stationary beam portion 22 and contact beam portion 24 diverge as they extend from the body or overlapping portion 26.

Contact beam 24 has a center portion 28 that contains a stiffening section 30. As contact beam 24 extends from overlapping portion 26, contact beam 24 splits at stiffening section 30 from a single beam into three beams. These beams include two outside straight beams 32 and 34 with a middle bent beam 36. As contact beam 24 further extends from overlapping portion 26 and extends beyond stiffening section 30, contact beam 24 merges back into a single beam. While the two outside straight beams are generally parallel to each other, the bent beam 36 extends in a direction considered upwardly (as shown in FIG. 6) towards stationary beam 22. Bent beam 36 forms an apex with a dimple pivotal point 38 in contact with stationary beam 22.

Contact beam 24 further has contact surface that is shown as a bump 40 that engages a male pin when mating. Contact beam 24 has an upwardly extending end ramp 42 to aid in guiding a mating pin (not shown) during insertion and to protect the pin and contact beam 24 from damage. The distance (D1) between the dimple pivotal point 38 and the contact bump 40 can be, for example, between about 0.8 mm and about 1.2 mm, typically between about 0.9 mm and about 1.1 mm.

Spring contact 20 has generally oppositely directed lugs. These are shown in FIG. 4 as a lug 44, considered a left lug, and a lug 46, considered a right lug. As shown in FIGS. 1, 2 and 3 housing 15 has a sidewall 48 with an aperture 52, considered a left aperture, and a sidewall 50 with an aperture 54, considered a right aperture. Aperture 52 and aperture 54 are position within housing 15 in a direction considered rearward. Left aperture 52 holds left lug 44 and right aperture 54 holds right lug 46 wherein spring contact 20 is secured from the rear of mating section 14. As shown in FIGS. 5 and 6 housing 15 has a wall 56, considered a top wall. Top wall 56 engages stationary beam 22 inhibiting the stationary beam from moving in a direction considered upward (as oriented in FIG. 6).

Housing 15 further includes a wall 58, considered a bottom wall (as oriented in FIG. 6), with a raised or inwardly extending section or platform 60 that functions as an inward directing ramp. As a mating male pin is inserted into mating section 14, the mating pin is moved towards contact surface such as bump 40 by the raised platform or inward directing ramp 60. As the mating pin is further inserted into mating section 14 it engages contact bump 40 that is urged to move in a direction considered upward. Due to the features of the spring contact 20 as generally discussed herein, the upward movement of contact beam 24 is resisted such that the contact force on the pin increases to levels similar to the pin contact force of larger conventional receptacle terminals that require more bulk to provide a contact force of this magnitude. Contact beam movement resistance is enhanced by the relative rigidity of the stationary beam portion 22 and the engagement thereof by the projecting dimple pivotal point 38 in reaction of the insertion engagement between the mating pin and the contact beam 24.

Top wall 56 has a lock and polarizing projection 62 for mounting receptacle terminal 10, as for example, to a panel with terminal receiving cavities. Top wall 60 also can have a guiding lip 64 to assist in guiding a male mating pin as it is inserted and to protect the mating pin and spring contact 20 during mating. Stationary beam 22 also can include a depression 66 providing overstress protection for contact beam 24.

It will be understood that there are numerous modifications of the illustrated embodiments described above which will be readily apparent to one skilled in the art, such as many variations and modifications of the miniature receptacle terminals and/or its components including combinations of features disclosed herein that are individually disclosed or claimed herein, explicitly including additional combinations of such features, or alternatively other types of miniature receptacle terminals. Also, there are many possible variations in the materials and configurations. These modifications and/or combinations fall within the art to which this approach relates and are intended to be within the scope of the claims, which follow.

What is claimed is:

1. A receptacle terminal comprising:

a body portion having a connection section along an end portion of the receptacle terminal and a mating section extending away from the connection section, the mating section being configured to mate with a complementary terminal;

a contact spring at the mating section of the housing, the contact spring including:

a. a stationary beam having a proximal length and a distal length;

b. a resilient contact beam having a proximal length and a distal length, the resilient contact beam having a contact surface and a stiffening section that includes a straight beam component and a bent beam component wherein a portion of the bent beam component is in close proximity to the stationary beam; and c. an overlapping portion wherein the respective proximal portions of the stationary beam and the resilient contact beam engage one another.

2. The receptacle terminal according to claim 1, wherein the stationary beam and the resilient contact beam diverge as they extend from the overlapping portion.

3. The receptacle terminal according to claim 1, wherein the stiffening section includes two parallel straight beams.

4. The receptacle terminal according to claim 1, wherein the bent beam includes an apex with a dimple pivotal point that is configured and positioned to engage the stationary beam upon insertion of a mating terminal component.

5. The receptacle terminal according to claim 1, wherein the contact surface is a bump.

6. The contact spring according claim 4, wherein the distance between the dimple pivotal point and the contact surface is between about 0.8 mm and about 1.2 mm prior to said insertion.

7. The receptacle terminal according to claim 1, wherein the contact spring further comprises at least one holding lug.

8. The receptacle terminal according to claim 7, wherein the contact spring comprises two holding lugs on opposite sides of the contact spring.

9. A receptacle terminal comprising:

a body portion and a contact spring within the body portion, the contact spring comprising:

a. a stationary beam having a proximal length and a distal length;

b. a resilient contact beam having a proximal length and a distal length, the resilient contact beam having a contact surface and a stiffening section that includes a straight beam component and a bent beam component wherein a portion of the bent beam component is in close proximity to the stationary beam; and c. an overlapping portion wherein the respective proximal portions of the stationary beam and the resilient contact beam connect to one another.

10. The receptacle terminal according to claim 9, further comprising a crimping section.

11. The receptacle terminal according to claim 9, wherein the stationary beam and the resilient contact beam diverge as they extend from the overlapping portion.

12. The receptacle terminal according to claim 9, wherein the stiffening section includes two parallel straight beams.

13. The receptacle terminal according to claim 9, wherein the bent beam forms an apex with a dimple pivotal point.

14. The receptacle terminal according to claim 9, wherein the contact surface is a bump.

15. The receptacle terminal according to claim 14, wherein the distance between the dimple pivotal point and the contact bump is between about 0.8 mm and about 1.2 mm.

16. The receptacle terminal according to claim 9, wherein the contact spring further comprises at least one holding lug.

17. The receptacle terminal according to claim 16, wherein the contact spring comprises two holding lugs.

18. The receptacle terminal according to claim 17, wherein the body portion includes a first wall and a second wall opposite the first wall with each wall having an aperture holding a lug and a third wall between the first and second wall wherein the third wall restricts movement of the stationary beam.

19. The receptacle terminal according to claim 18, wherein the body portion includes a fourth wall opposite the third wall and the fourth wall has a raised platform in proximity to the contact bump.

20. The receptacle terminal according to claim 18, wherein the third wall includes a lock and polarizing projection.

21. The receptacle terminal according to claim 18, wherein the third wall includes a guide panel.

22. The receptacle terminal according to claim 9, wherein the stationary beam includes a depression to prevent excessive movement of the resilient contact beam.

* * * * *